US008975500B2

(12) United States Patent
Iriyama

(10) Patent No.: US 8,975,500 B2
(45) Date of Patent: Mar. 10, 2015

(54) MUSIC DATA DISPLAY CONTROL APPARATUS AND METHOD

(71) Applicant: Yamaha Corporation, Shizuoka-ken (JP)

(72) Inventor: Tatsuya Iriyama, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 98 days.

(21) Appl. No.: 13/667,903

(22) Filed: Nov. 2, 2012

(65) Prior Publication Data

US 2013/0112062 A1 May 9, 2013

(30) Foreign Application Priority Data

Nov. 4, 2011 (JP) ..... 2011-242244
Sep. 24, 2012 (JP) ..... 2012-209486

(51) Int. Cl.
*G10H 7/00* (2006.01)
*G10H 1/00* (2006.01)

(52) U.S. Cl.
CPC ..... *G10H 1/0008* (2013.01); *G10H 2220/011* (2013.01); *G10H 2220/126* (2013.01)
USPC ..... 84/600; 84/483.1

(58) Field of Classification Search
USPC ..... 84/470 R, 477 R, 483.1, 600
See application file for complete search history.

(56) References Cited

U.S. PATENT DOCUMENTS 6,582,235 B1 6/2003 Tsai et al.
7,199,299 B2 4/2007 Asakura
7,365,261 B2 * 4/2008 Hirano ..... 84/600
7,453,035 B1 * 11/2008 Evans et al. ..... 84/477 R
7,754,955 B2 * 7/2010 Egan ..... 84/600
8,294,016 B2 * 10/2012 Franzblau ..... 84/609
2005/0241462 A1 11/2005 Hirano
2009/0114079 A1 * 5/2009 Egan ..... 84/477 R
2014/0047971 A1 * 2/2014 Akazawa et al. ..... 84/609

FOREIGN PATENT DOCUMENTS

EP 1 089 254 A1 4/2001
JP 2010-186063 A 8/2010

(Continued)

OTHER PUBLICATIONS

European Search Report mailed Mar. 13, 2001, for EP Application No. 12190730.7, seven pages.

(Continued)

*Primary Examiner* — Jeffrey Donels
(74) *Attorney, Agent, or Firm* — Morrison & Foerster LLP

(57) ABSTRACT

A display area, in which a note is displayed on two-axis coordinates configured by a tone pitch axis and a time axis, is displayed on a display device. A display magnification ratio used in the display area is variable. A note image of a given note is displayed in the display area to be arranged in correspondence with a tone pitch and a tone generation time of the note. The size of the note image is varied with the display magnification ratio. Relevant information is displayed in association with the note image displayed in the display area in such a manner that the relevant information is arranged inside the note image of the note in a first display state and the relevant information is arranged outside the note image of the note in a second display state with a display magnification ratio lower than that of the first display state.

19 Claims, 8 Drawing Sheets

(56) References Cited

FOREIGN PATENT DOCUMENTS

| | | | |
|---|---|---|---|
| JP | 2011-128186 | A | 6/2011 |
| JP | 2011-180428 | A | 9/2011 |

OTHER PUBLICATIONS

Logic Pro 8 User Manual, "Editing MIDI Events in the Piano Roll Editor", Apple Inc., 2007, 124 pages.

Anonymous (Jun. 29, 2007). Vocaloid2 Owner's Manual, 110 pages.

* cited by examiner

MUSIC DATA DISPLAY CONTROL APPARATUS AND METHOD

BACKGROUND

The present invention relates to a technique for displaying music data.

Techniques for displaying a time series of a plurality of notes designated by music data on a display device have conventionally been suggested as schemes for displaying music score without use of a staff notation. For example, Japanese Patent Application Laid-open Publication No. 2011-128186 discloses a technique for displaying an image (hereinafter, referred to as a "note image") that expresses each note of a music piece in a piano-roll type music score display area indicated by two-axis coordinates configured by a combination of a tone pitch axis and a time axis, and for arranging and displaying a voice code (for example, one or more letters of lyrics corresponding to each note of a singing music piece) granted to each note, for example, in an inside of a rectangular note image.

However, when a display magnification ratio used in the music score display area decreases (for example, when images to be displayed in the music score display area is are compressed or reduced in a time-axis direction), a note image is compressed or reduced accordingly. Therefore, there is a possibility that the voice code with a predetermined display size is not fit into the inside of the voice image. If the display size of the voice code decreases in conjunction with the compression or reduction in the note image, the voice code can be arranged inside the voice image. In this case, however, there is a problem in that it is difficult for a user to view the voice code clearly. In the above description, the voice code such as lyrics has been exemplified. However, the same problem may also occur when various kinds of information (for example, a character string or a sign indicating a musical expression such as vibrato) associated with each note is written together and displayed in the note image.

SUMMARY OF THE INVENTION

In view of the foregoing, it is an object of the invention is to provide a music data display control apparatus capable of ensuring visibility of information associated with each note and displaying the information, even when a music score display area is reduced and displayed.

In order to accomplish the above-mentioned object, the present invention provides a music data display control apparatus, which comprises: a control section adapted to perform display control such that: a display area, in which a note is displayed on two-axis coordinates configured by a combination of a tone pitch axis and a time axis, is displayed on a display device, a display magnification ratio applied to the display area being variable; a note image of a given note is displayed in the display area to be arranged in correspondence with a tone pitch and a tone generation time of the given note, a size of the note image being varied in accordance with the display magnification ratio; and relevant information is displayed in association with the note image displayed in the display area, wherein in a first display state with a first display magnification ratio, the relevant information is arranged inside the note image of the note and in a second display state with a second display magnification ratio lower than the first display magnification ratio of the first display state, the relevant information is arranged in a manner different from an arrangement in the first display state. According to an embodiment, the relevant information is arranged outside the note image of the note in the second display state.

According to the present invention, in the first display state in which the display magnification ratio applied to the music score display area is relatively high, the relevant information is arranged inside each note image. In the second display state in which the display magnification ratio applied to the display area is relatively low, the relevant information is arranged in a manner different from the arrangement in the first display state; e.g., the relevant information is arranged outside each note image. Accordingly, even when images displayed in the display area are compressed or reduced, the relevant information can be displayed in an appropriate form allowing a user to easily view the display area. Further, the relevant information may be any information (attribute information) associated with the note. For example, the voice codes (lyrics or phoneme symbols) given to the notes can be exemplified as the relevant information.

According to one embodiment of the present invention, in the second display state, the control section may perform the display control of the relevant information such that the relevant information is arranged in the periphery of the note image of the note in the display area. Thus, since the relevant information is arranged in the periphery of the note image of the note in the display area, it is possible to obtain the advantage that the user can easily comprehend a relation between the note image and the relevant information. Examples of this embodiment will be described later as first to sixth embodiments.

According to one embodiment of the present invention, in the second display state, the control section may perform the display control such that parts of the relevant information are displayed in the time axis direction in the display area. Thus, parts of the relevant information are arranged selectively in the display area. Therefore, even when the display magnification ratio is extremely decreased, it is possible to obtain the advantage that the user can view the relevant information although the user views the parts of the relevant information. An example of this embodiment will be described as a third embodiment.

According to one embodiment of the present invention, in the second display state, the control section may perform the display control such that a group of a plurality of characters forming the relevant information corresponding to one or more continuous notes is displayed in line in a tone pitch axis direction in the display area. Thus, since one group of the plurality of characters forming the single relevant information or the plurality of continuous pieces of relevant information is displayed in line in the tone pitch axis direction in the display area, it is possible to obtain the advantage of easily ensuring the display size of each relevant information, compared to a case where the plurality of pieces of relevant information is arranged in the time axis direction. An example pf this embodiment will be described as a fourth embodiment.

According to one embodiment of the present invention, in the second display state, the control section may perform the display control such that when a user designates the note image using a pointer, the relevant information is displayed in association with the note image. Thus, the relevant information corresponding to the note image designated with the pointer is displayed in association with the note image. Therefore, when the note image is not designated with the pointer, the relevant information is not displayed, so that it is possible to obtain the advantage that the display in the display area is simplified. Further, it is possible to obtain the advantage that the user can arbitrarily view desired relevant information in accordance with the designation by the pointer. Examples of this embodiment will be described as the fifth and sixth embodiments. The embodiment of the present invention is not limited to the case where the user designates only one note image. Even when the plurality of note images are designated, the relevant information can be displayed for each of the designated note images.

According to one embodiment of the present invention, in the second display state, the control section may perform the display control such that the relevant information is displayed in an auxiliary area, other than the display area, set on the display device. Thus, since each relevant information is displayed in the auxiliary area separate from the display area in which each note image is arranged, an operation of individually confirming the arrangement of the time series of the notes and individual relevant information is facilitated, compared to a configuration in which both the note image and the relevant information are arranged in the display area. Further, in a configuration in which the relevant information is arranged at a position corresponding to the tone generation time point of each note in the time axis direction in the auxiliary area, it is possible to obtain the advantage that the user can easily comprehend a correspondence between each note image and each relevant information. An example of this embodiment will be described as a seventh embodiment.

The music data display control apparatus according to the present invention can, of course, be realized by hardware (electronic circuit) such as a digital signal processor (DSP) dedicated to displaying music data and can also be realized in cooperation between a general arithmetic processing device such as a central processing unit (CPU) and a program. A program according to the present invention can be provided in a form stored in a computer-readable recording medium and can be installed in a computer. The program can also be provided in a form to be delivered via a communication network and can be installed in a computer.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

<First Embodiment>

Figure 1:
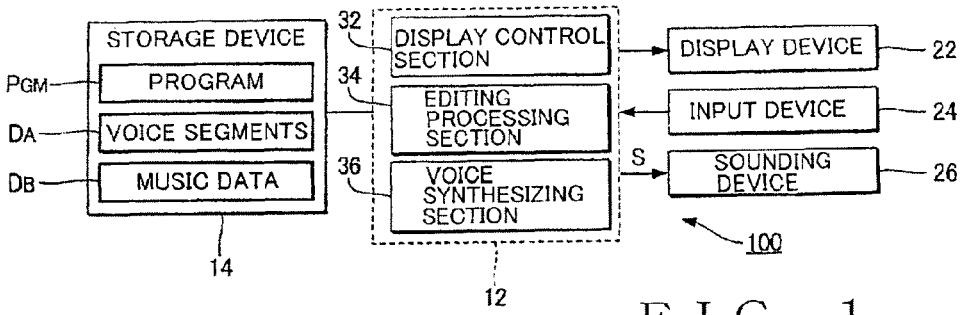
FIG. 1 is a block diagram illustrating a voice synthesizing apparatus according to an embodiment of a music data display control apparatus of the present invention.

FIG. 1 is a block diagram illustrating a voice synthesizing apparatus 100 employing an embodiment of a music data display control apparatus of the present invention. The voice synthesizing apparatus 100 is a signal processing apparatus that generates a voice signal S of a singing voice through segment connection type voice synthesis. As illustrated in FIG. 1, the voice synthesizing apparatus 100 may be realized by a computer system that includes an arithmetic processing device 12, a storage device 14, a display device 22, an input device 24, and a sounding device 26. For example, the voice synthesizing apparatus 100 may be realized by a stationary information processing apparatus (personal computer) or a portable information processing apparatus (a portable telephone or a portable information terminal).

The arithmetic processing device 12 realizes a plurality of functions (i.e., functions as a display control section 32, an editing processing section 34, and a voice synthesizing section 36) by executing a program PGM stored in the storage device 14. The functions of the arithmetic processing device 12 may be distributed to a plurality of integrated circuits or some of the functions may be realized by a dedicated electronic circuit (for example, a DSP). In general, the arithmetic processing device 12 of the voice synthesizing apparatus 100 and a portion associated therewith (the program PGM or the like) function as a music data display control apparatus of the present invention.

The display device 22 (for example, a liquid crystal display device) displays an image instructed by the arithmetic processing device 12. The input device 24 is a device (for example, a pointing device such as a mouse or a keyboard) that receives an instruction from a user. Further, a touch panel integrally configured with the display device 22 may be utilized as the input device 24. The sounding device 26 (for example, a headphone and/or a speaker) releases sound waves in accordance with the voice signal S generated by the arithmetic processing device 12.

The storage device 14 stores the program PGM to be executed by the arithmetic processing device 12 and/or various kinds of data (data sets of voice segments DA and music data DB) used by the arithmetic processing device 12. A known recording medium such as a semiconductor recording medium or a magnetic recording medium, or a combination of a plurality of recording media can be utilized as the storage device 14.

The data sets of voice segments DA are a voice synthesis library that includes a plurality of segment data each corresponding to individual one of different voice segments (for example, each of the segment data comprises a series of waveform samples of a corresponding voice segment) and is used for providing with a material of voice synthesis. The voice segment may be a phoneme (for example, a vowel or a consonant) which is the minimum unit used to discriminate between linguistic meanings or a chain of phonemes (for example, a diphone or a triphone) formed by connecting a plurality of phonemes to one another. In this disclosure, a voice may typically refer to a linguistic human voice. Accordingly, for example, human voices for singing specific lyrics can be synthesized by combining a plurality of voice segments selected from the voice segments DA.

Figure 2:
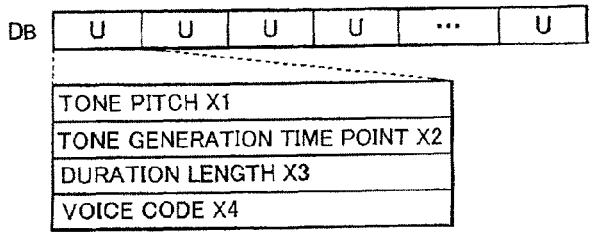
FIG. 2 is a schematic diagram illustrating music data.

The music data DB includes a data group for designating a plurality of notes that constitute a music piece, and a plurality of such data groups may be included in the music data DB. For example, as illustrated in FIG. 2, the music data DB of one music piece includes a plurality of unit data U corresponding to each note for constituting the one music piece. Each unit data U is configured by a data set for designating a tone pitch X1, a tone generation time point (tone generation time) X2, a duration length X3, and a voice code X4 of a note. The tone pitch X1 is data that indicates a tone pitch (in practice, a note number given to each tone pitch) of the note. The tone generation time point X2 is data that indicates a time (tone start time point) when a tone of the note is generated. The duration length X3 is data that indicates a time length (phonetic value) in which generation of the tone of the note continues. That is, a tone generation time period of one note is defined by the tone generation time point X2 and the duration length X3. The tone generation time point X2 and the duration length X3 are correspond to information indicative of tone generation time. The voice code X4 may be code data representing information expressed by a human voice, such as lyrics, to be generated in correspondence with the note, or may be other data representing given information associated with the note without limitation to the code data above mentioned. Namely, the voice code X4 is relevant information associated with the note. For example, the voice code X4 (relevant information) may be data that expresses lyrics (or other signs and/or descriptions) in characters (for example, Alphabet characters, Cyrillic characters, Arabic characters, Chinese characters, or Japanese kana and kanji characters) as graphemes in a specific linguistic system, or may be data that expresses lyrics in phonetic symbols. To facilitate the following description, characters in which Japanese lyrics are expressed in Roman characters will be exemplified as the voice code X4.

Figure 3:
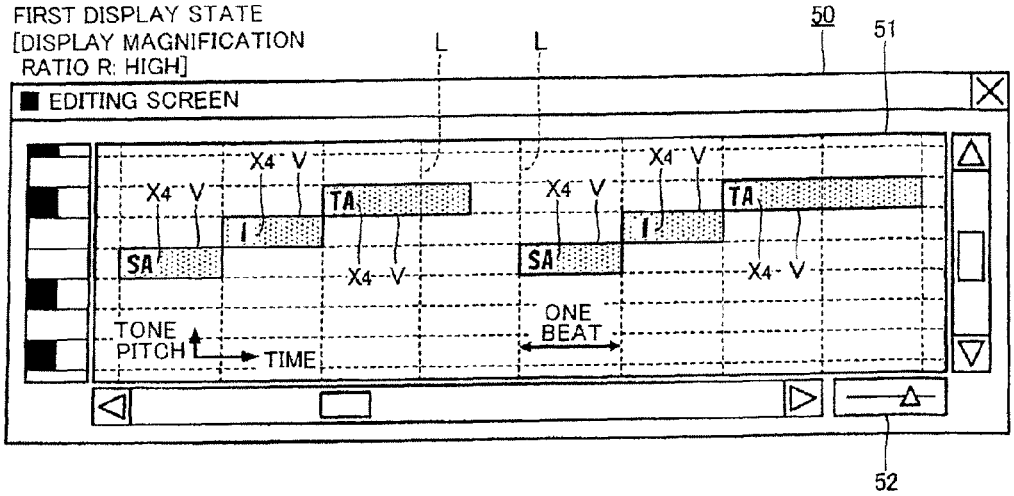
FIG. 3 is a schematic view of an editing screen in a first display state according to a first embodiment of the present invention.

The display control section 32 in FIG. 1 controls to display an editing screen 50 as shown in FIG. 3 on the display device 22 so that the user can visually confirm the contents of the music data DB. As shown in FIG. 3, the editing screen 50 includes a music score display area 51. The music score display area 51 is a display area that is formed by a two-dimensional coordinate plane displaying a music score in a form similar to a known piano-roll type display screen. That is, the music score display area 51 is configured by two-axis coordinates (for example, horizontal and vertical axes) intersecting each other. A time axis of an object of display (a music score, that is, a time series of a plurality of notes) can be assigned to one (for example, the horizontal axis) of the two-axis coordinates and a tone pitch axis of the object of display can be assigned to the other (for example, the vertical axis) thereof. In FIG. 3, vertical broken lines L arranged at regular intervals in the time axis direction indicate a boundary (hereinafter, referred to as a "beat line") of a period corresponding to one beat within a music piece. That is, an interval between two beat lines L adjacent to each other on the time axis corresponds to the time length of one beat of the music piece. In this way, the display control section 32 performs display control such that the display area 51, in which a note is displayed on the two-axis coordinates configured by a combination of the tone pitch axis and the time axis, is displayed on the display device 22. A display magnification ratio applied to (or used in) the display area 51 can be varied to decrease and/or increase. In the embodiment, the display magnification ratio applied to (or used in) the display area 51 can be varied in a direction of the time axis. Alternatively, the display magnification ratio applied to (or used in) the display area 51 may be varied in a direction of the tone pitch axis or both directions of the time axis and the tone pitch axis.

In the music score display area 51, a note image V representing (or rendering) each note designated by the music data DB is displayed at a two-dimensional arrangement in accordance with the tone pitch and a tone generation time. In the first embodiment, the note image V is a rectangular image. One or more note images V for one or more note existing in a partial portion (hereinafter, referred to as a "display target portion") of the music piece corresponding to the music data DB are displayed in the music score display area 51. The position of the note image V in the tone pitch axis (vertical axis) direction is set based on the data of the tone pitch X1 included in the music data DB. The position (time-series arrangement) of the note image V in the time axis (horizontal axis) direction is set based on the data of the tone generation time point X2 included in the music data DB. The display length of the note image V in the time axis direction is set based on the data of the duration length X3 included in the music data DB. That is, the longer the duration length X3, the longer the display length of the note image V. Thus, the note image V according to the embodiment expresses the tone pitch X1, the tone generation time point X2, and the duration length X3 of a given note. Tone signals corresponding to the notes are automatically synthesized according to a time sequence of the plurality of notes displayed in the music score display area 51 so that acoustic sounds can be produced through the sounding device 26 based on the generated tone signals. In this way, the display control section 32 also performs display control such that the note image of a given note is displayed in the display area 51 to be arranged in correspondence with the tone pitch and the tone generation time. As mentioned below, the size of each note image V displayed in the display area 51 varies in accordance with the display magnification ratio applied to the display area 51.

As shown in FIG. 3, the editing screen 50 includes an operator image (slider image) 52 used for a user to change a display magnification ratio R in the time axis direction of the music score display area 51. The user can appropriately operate the operator image 52 using the input device 24. The display control section 32 sets the display magnification ratio R in the time axis direction to be variable in response to a user's operation to the operator image 52.

In this embodiment, the display magnification ratio R corresponds to the display length of a unit time (for example, the time length of one beat of the music piece) of the music piece in the music score display area 51. Accordingly, as the display magnification ratio R increases (the display length of the unit time in the music score display area 51 increases), the display target portion in the music piece is narrowed. Therefore, the more the number of bars or the number of beats displayed in the music score display area 51 in the music piece decreases (a width of the beat line L expands) and the more the size of each note image V expands in the time axis direction. On the other hand, as the display magnification ratio R decreases (the display length of the unit time in the music score display area 51 decreases), an extent of the display target portion in the music piece is broadened. Therefore, the number of bars or the number of beats displayed in the music score display area 51 in the music piece increases (the width of the beat line L reduces) and the size of the note image V is reduced in the time axis direction. In this embodiment, even when the display magnification ratio R is varied, a physical display size of the music score display area 51 itself is not changed.

Figure 4:
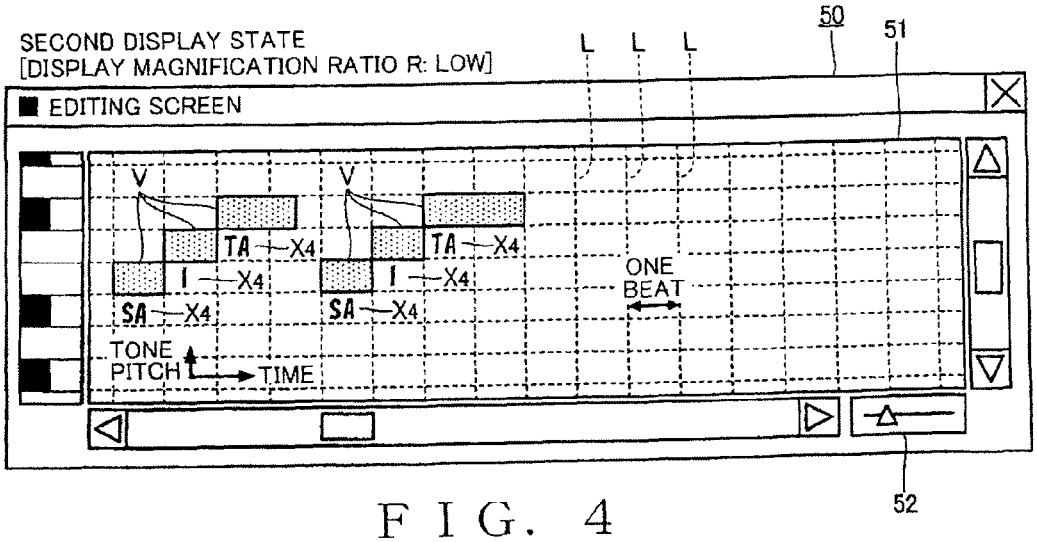
FIG. 4 is a schematic view of the editing screen in a second display state according to the first embodiment.

The display control section 32 acquires the music data DB to be displayed from the storage device 14 and controls the voice code X4 of each note included in the acquired music data DB such that the voice code X4 is displayed in various different forms or arrangements in accordance with a designated display magnification ratio R. Specifically, the display control section 32 controls the display position of the voice code X4 such that the display position of the voice code X4 is varied between at least two states in which the display magnification ratios R are different, that is, a first display state in which the display magnification ratio R is relatively high (first display magnification ratio) and a second display state in which the display magnification ratio R is relatively low (second display magnification ratio). The first display state is, for example, a state (a case where the display magnification ratio R is greater than a threshold value) in which the display length of the note image V, which indicates the shortest note among a plurality of notes designated by the music data DB, in the time axis direction is greater than a predetermined value. The second display state is, for example, a state (a case where the display magnification ratio R is less than the threshold value) in which the display length of the note image V, which indicates the shortest note among the plurality of notes indicated by the music data DB, in the time axis direction is less than the predetermined value. Accordingly, the size of the note image V is larger in the first display state than in the second display state. FIG. 3 is a diagram illustrating a display example of the editing screen 50 in the first display state. FIG. 4 is a diagram illustrating a display example of the editing screen 50 in the second display state. The display control section 32 may be configured to acquire the music data DB to be displayed from any source (for example, an external server apparatus) without limitation to the storage device 14.

In the first display state, as illustrated in FIG. 3, the display control section 32 arranges the voice code X4, which is designated in each note within the display target portion by the music data DB, inside the outline of the note image V of the note. That is, the voice code X4 is displayed so as to overlap the note image V.

On the other hand, in the second display state with the display magnification ratio R lower than that of the first display state, the display control section 32 arranges the voice code X4, which is designated in each note within the display target portion by the music data DB, outside the note image V, as illustrated in FIG. 4. For example, the voice code X4 of each note is arranged at a position distant from the bottom side of the note image V of each note by a predetermined distance in the negative direction (in the lower direction) of the tone pitch axis direction. The position of the voice code X4 in the time axis direction is selected in accordance with the tone generation time point X2, like the note image V.

As described above, the voice code X4 is displayed inside the note image V at a normal display time (the first display state) and is displayed outside the note image V at a reduction display time (the second display state). That is, when the display magnification ratio R is gradually decreased in the first display state in which the voice code X4 is arranged inside the note image V, each note image V is gradually reduced in the time axis direction. At a stage when the display length of the note image V in the time axis direction falls below the predetermined value (namely, at a stage when the display magnification ratio R falls below the threshold value), the state transits from the first display state to the second display state and the voice code X4 is moved to the outside from the inside of each note image V. For example, the display size of the voice code X4 in the first display state is the same as that in the second display state. However, the display size of the voice code X4 can be appropriately decreased further in the second display state than in the first display state, as long as the voice code X4 is easily visible. In this way, the control section 32 also performs display control such that the relevant information (voice code X4) is displayed in association with the note image V displayed in the display area 51, and that the relevant information (voice code X4) is arranged inside the note image V of the note in the first display state and the relevant information (voice code X4) is arranged outside the note image V of the note in the second display state with the display magnification ratio lower than that of the first display state.

Figure 5A:
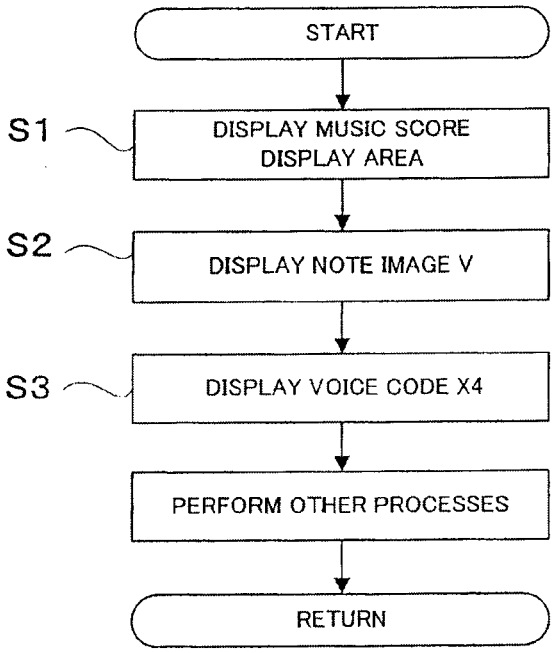
FIGS. 5A and 5B are flowcharts each showing an example of display control processing by a display control section.

FIG. 5A is a flowchart illustrating schematic steps of the main process of a computer program executable by a processor of the arithmetic processing device 12 to realize the function of the display control section 32. In step S1, display control is performed in such a manner that the music score display area 51 for displaying therein a note on the two-axis coordinates configured by the combination of the tone pitch axis and the time axis is displayed. As mentioned above, the display magnification ratio R applied to the music score display area 51 is variable according to a user's operation or the like. In other words, display elements displayed in the music score display area 51 can be contracted or expanded in the time axis direction in accordance with the display magnification ratio R. In step S2, display control is performed in such a manner that the note image V of a given note is displayed to be arranged in correspondence with the tone pitch X1 and the tone generation time (the tone generation time point X2 and the duration length X3) in the display area 51. In step S1 or S2, the display control section 32 performs a process for changing so as to contract or expand the display elements necessary in the music score display area 51 in the time axis direction in accordance with the display magnification ratio R. Namely, in step S2, the display control section 32 also performs a changing process of increasing or decreasing the size of the note image V in the time axis direction in accordance with the display magnification ratio R. In step S3, display control is performed in such a manner that the relevant information (voice code X4) is displayed in association with the note image V displayed in the music score display area 51, and that the relevant information (voice code X4) is arranged inside the note image V of the note in the first display state and the relevant information (voice code X4) is arranged outside the note image V of the note in the second display state. Here, the display magnification ratio R of the second display state is lower than the display magnification ratio R of the first display state. Step S3 corresponds to a function of the third control section 32*c*. As is generally known, a process including the steps S1 to S3 are repeatedly performed.

Figure 5B:
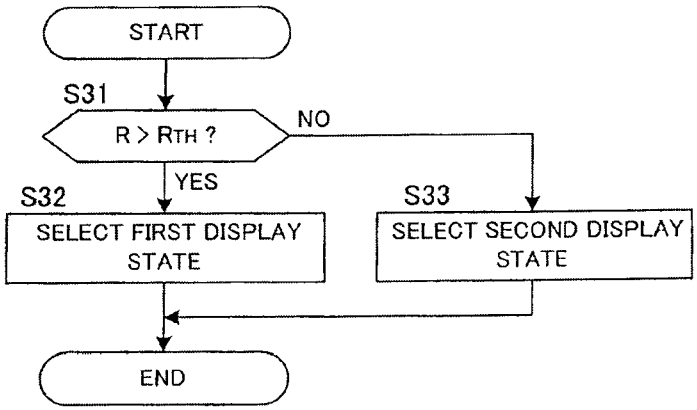

FIG. 5B is a flowchart illustrating the details of the process which is performed in step S3 described above and in which the display position of the relevant information (voice code X4) is controlled in accordance with the display magnification ratio R. For example, the process in FIG. 5B is performed, whenever the user operates the input device 24 to give an instruction of designating (varying) the display magnification ratio R. Further, when the display of the editing screen 50 is started, for example, the first display state is selected at first. When the process in FIG. 5B starts, the display control section 32 determines whether the display magnification ratio (varied display magnification ratio) R instructed from the user is greater than a predetermined threshold value RTH (S31). When the display magnification ratio R is greater than the threshold value RTH (YES in step S31), the display control section 32 selects the first display state (S32). That is, the voice code X4 of each note is arranged inside the note image V. Conversely, when the display magnification ratio R is equal to or less than the threshold value RTH (NO in step S31), the display control section 32 selects the second display state (S33). That is, the voice code X4 of each note is arranged outside the note image V. The above-described processes are performed at each time when the user's operation for designating (or varying) the display magnification ratio R is made, and then the voice code X4 of each note is consequently displayed in the display form (the first display state or the second display state) suitable for the display magnification ratio R.

In FIG. 1, the editing processing section 34 functions to edit the value of each data or the state included in the music data DB in response to a user's operation or an instruction to a display element in the music score display area 51. For example, when an instruction to change the position of a note image V existing in the music score display area 51 is received, the tone pitch X1 and the tone generation time point X2 of the unit data U corresponding to the note image V are changed. When an instruction to change the length of the note image V is received, the duration length X3 of the unit data U corresponding to the note image V is changed. Further, when an instruction to change or add the voice code X4 corresponding to each note image V is received, the voice code X4 of the unit data U corresponding to the note image V is changed or added. Furthermore, when an instruction to add the note image V is received, the unit data U corresponding to the note image V is added to the music data DB.

The voice synthesizing section 36 shown in FIG. 1 generates a voice signal S using the voice segments DA and the music data DB. Specifically, first, the voice synthesizing section 36 sequentially selects the segment data of the voice segments corresponding to the voice codes X4 for each note designated by the music data DB from the voice segments DA. Second, the voice synthesizing section 36 adjusts each segment data to the tone pitch X1 and the duration length X3 designated by the unit data U. Third, the voice synthesizing section 36 generates the voice signal S by arranging and connecting the adjusted segment data in the tone generation time points X2 designated by the unit data U one another. The voice signal S generated by the voice synthesizing section 36 is supplied to the sounding device 26 and is reproduced as sound waves.

As described above, the voice code X4 is displayed inside the note image V in the first display state and the voice code X4 is displayed outside the note image V in the second display state with the display magnification ratio R lower than that of the first display state. Accordingly, according to the first embodiment, even when the display magnification ratio R in the music score display area 51 is reduced, it is possible to obtain the advantage of sufficiently ensuring the visibility of the voice code X4. From the viewpoint of clarifying the correspondence between the each note (note image V) and the voice code X4, the display of the arrangement of the voice code X4 inside the note image V is advantageous. That is, according to the first embodiment, when the first display state is compared to the second display state in which the voice code X4 is configured to be displayed outside the note image V, the first display state is more advantageous in that the correspondence between the note image V and the voice code X4 is clearly comprehended. Even in the second display state, however, the correspondence between the voice code X4 and the note image V can be comprehended, since the voice code X4 is arranged in the periphery of the note image V.

<Second Embodiment>

A second embodiment of the present invention will be described. The above-described reference numerals are given to the same constituent elements as those of the first embodiment in the operations and functions in each embodiment to be exemplified, and the detailed description thereof will be appropriately omitted.

Figure 6:
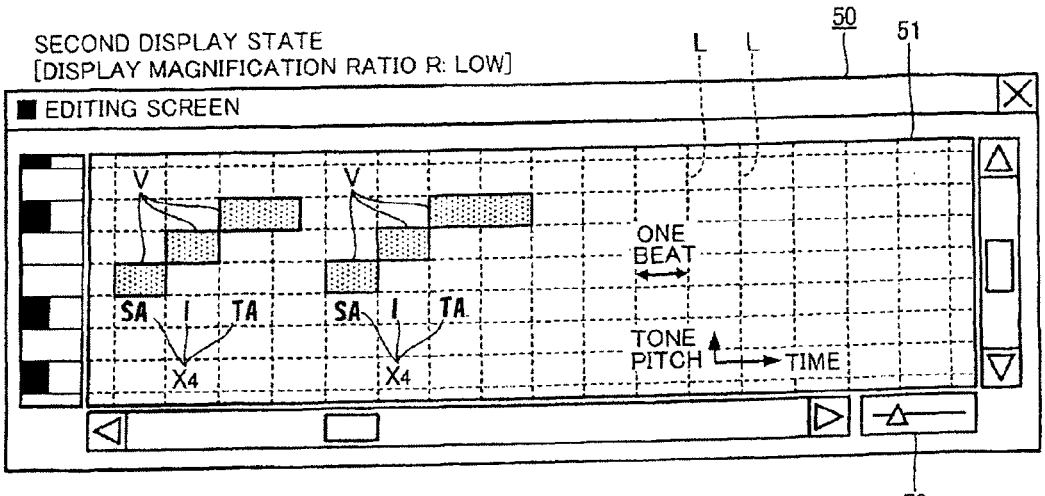
FIG. 6 is a schematic view of the editing screen in the second display state according to a second embodiment of the present invention.

FIG. 6 is a schematic view illustrating an editing screen 50 in the second display state according the second embodiment. In the first embodiment, the positions of the voice codes X4 in the tone pitch axis direction are configured to differ from each other for each note in the second display state. In the second embodiment, as illustrated in FIG. 6, the plurality of voice codes X4 in the music score display area 51 is arranged in a line in the time axis direction. Specifically, the display control section 32 arranges the plurality of voice codes X4 in the music score display area 51 in a straight line at positions located below by suitable distances from the bottom side of the beginning (leftmost side) note image V in the music score display area 51. That is, the positions of the plurality of voice codes X4 are common in the tone pitch axis direction. The position of each voice code X4 in the time axis direction is selected in accordance with the tone generation time point X2 of each note, as similar in the first embodiment. The display image in the first display state is the same as that of the first embodiment.

In the second embodiment, the same advantages as those of the first embodiment can be obtained. In the second embodiment, since the plurality of voice codes X4 is arranged in the straight line in the time axis direction, it is possible to obtain the advantage that the user can easily confirm the time series of the voice codes X4, compared to the first embodiment.

<Third Embodiment>

Figure 7:
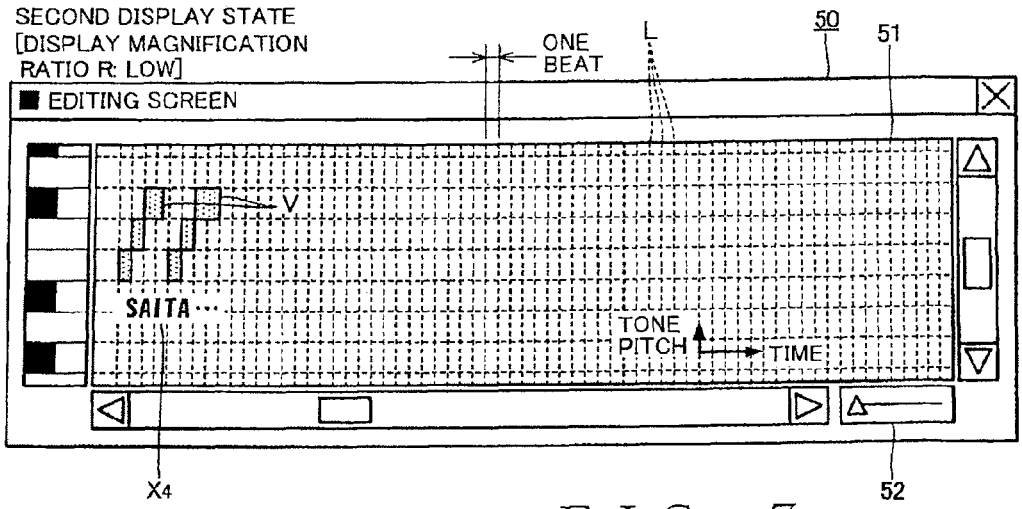
FIG. 7 is a schematic view of the editing screen in the second display state according to a third embodiment of the present invention.

FIG. 7 is a schematic view illustrating an editing screen 50 according to a third embodiment. In FIG. 7, a display example of the editing screen 50 is illustrated where the display magnification ratio R is further decreased from the second display state exemplified in FIG. 6. The display image in the first display state is the same as that of the first embodiment.

When the display magnification ratio R falls below a predetermined threshold value in the second display state, the display control section 32 divides a time series of a plurality of voice codes X4 corresponding to the notes in the music score display area 51 into the front and rear portions on the time axis, and arranges only the front portion in the music score display area 51 (outside each note image V), as illustrated in FIG. 7. That is, the rear portion is not displayed. In FIG. 7, a case is exemplified where the time series of the voice codes X4, "sa-i-ta, sa-i-ta," in the display target portion is divided into the front portion, "sa-i-ta," and the rear portion, "sa-i-ta," and the rear portion is not displayed. Any method of dividing the plurality of voice codes X4 into the front and rear portions can be used. For example, the time series of the plurality of voice codes X4 can be divided into the front and rear portions using a rest (for example, a time point at which tone generation periods of the notes in tandem are separated from each other on the time axis) in a music piece or a time point designated by a user as a boundary.

In the third embodiment, it is possible to obtain the same advantages as those of the first embodiment. In the third embodiment, when the display magnification ratio R is decreased, some of the plurality of voice codes X4 are omitted and only the remaining portion is displayed. Therefore, even when the display magnification ratio R is extremely decreased, it is possible to obtain the advantage that the user can partially confirm the voice codes X4.

Figure 8:
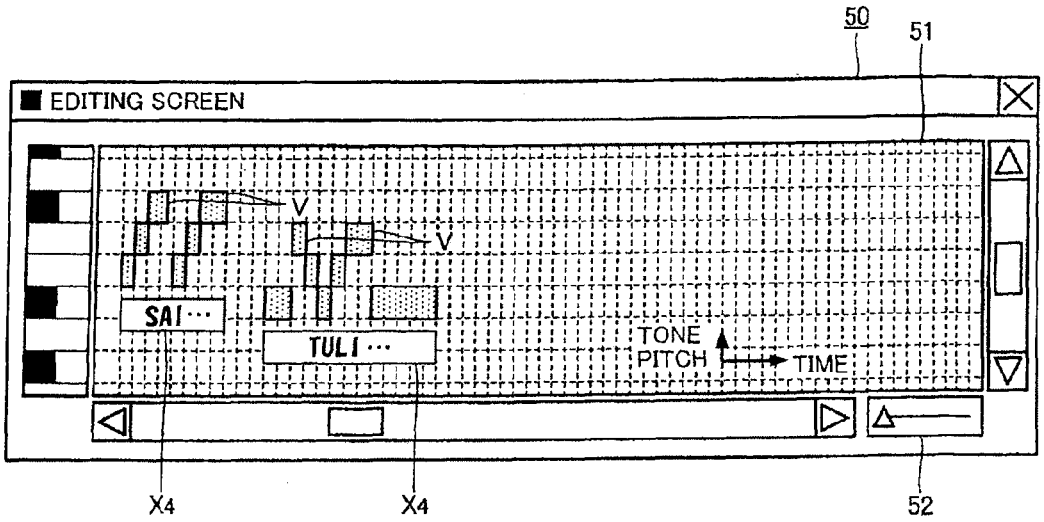
FIG. 8 is a schematic view of the editing screen in the second display state according to a modified example of the third embodiment of the present invention.

Further, the time series of the note images V can be divided into a plurality of sets (hereinafter, referred to as "phrases") using a rest in a music piece as a boundary and the time series of the voice codes X4 can be arranged for each phrase. For example, in FIG. 8, a case is exemplified when the phrase of the voice code X4, "saita, saita," and the phrase of the voice code X4, "tulip no hana ga," are designated at positions in tandem. The voice code X4 of each phrase is arranged to the rear at a position (a position at the start time point of the note image V) corresponding to the beginning note image V in the phrase and a portion (end side) of the voice code X4 is omitted so as not to overlap with the immediately subsequent frame. For example, in the example of FIG. 8, the voice code X4 subsequent to the beginning side "sai" of the voice code X4 of the front phrase "saita, saita" is omitted and the voice code X4 subsequent to the beginning side "tuli" of the voice code X4 of the rear phrase, "tulip no hana ga," is omitted. As understood from the example of FIG. 8, the position of the voice code X4 may be configured to be changed in accordance with the note image V. Further, the voice code X4 and the note image V may be displayed to overlap each other (one of the voice code X4 and the note image V is arranged at the front of the other thereof).

<Fourth Embodiment>

Figure 9:
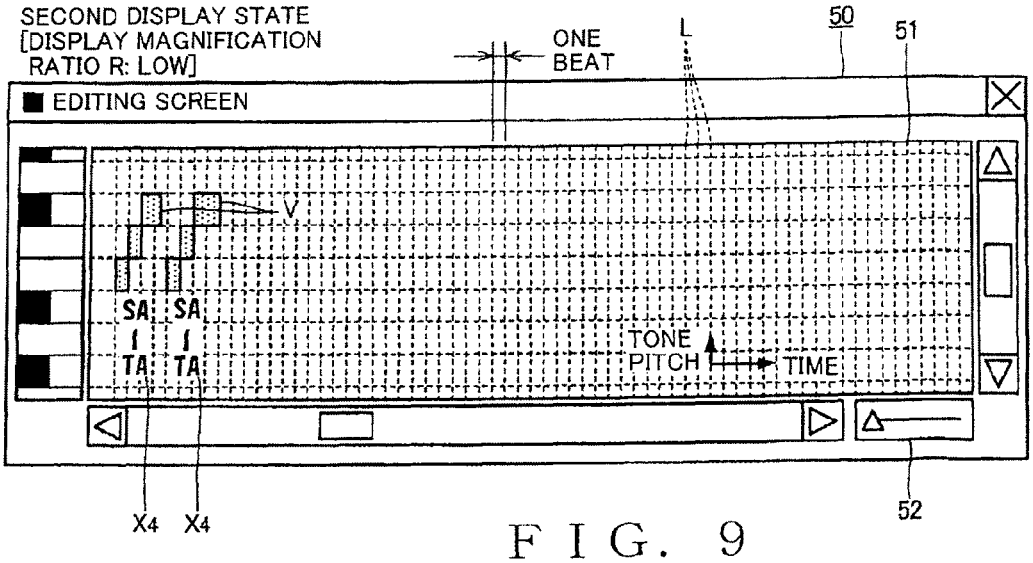
FIG. 9 is a schematic diagram illustrating an editing screen in a second display state according to a fourth embodiment of the present invention.

FIG. 9 is a schematic view illustrating an editing screen 50 according to a fourth embodiment. In FIG. 9, a display example of an editing screen 50 is illustrated when the display magnification ratio R is further decreased from the second display state exemplified in FIG. 6, as in FIG. 7. The display image in the first display state is the same as that of the first embodiment.

When the display magnification ratio R falls below a predetermined threshold value in the second display state, the display control section 32 divides the time series of the plurality of voice codes X4 corresponding to the notes in the music score display area 51 into a plurality of portions (hereinafter, referred to as partial code series), and arranges the plurality of voice codes X4 of the partial code series in a line along the tone pitch axis direction, as illustrated in FIG. 9. Specifically, the plurality of voice codes X4 of the partial code series are arranged in the tone pitch axis direction using, as start time points, positions located below by a suitable distance from the bottom side of the note image V corresponding to the beginning voice code X4 among the partial code series. In FIG. 9, a case is exemplified where the time series of the voice codes X4, "saita, saita," in the display target portion is divided into the first-half partial code line, "saita" and the second-half partial code, "saita". Any method of dividing the plurality of voice codes X4 into the partial code series can be used. For example, the time series of the plurality of voice codes X4 can be divided into the plurality of partial code series using a rest in a music piece or a time point designated by the user as a boundary. In this embodiment, one group of the plurality of characters displayed to be arranged in a line along the tone pitch axis direction forms one or more continuous pieces of relevant information.

In the fourth embodiment, it is possible to obtain the same advantages as those of the first embodiment. In the fourth embodiment, when the display magnification ratio R is decreased, the arrangement direction of the plurality of voice codes X4 is changed from the time axis direction to the tone pitch axis direction (vertical direction). Therefore, even when the display magnification ratio R is extremely decreased, it is possible to obtain the advantage that the voice codes X4 can be appropriately arranged.

<Fifth Embodiment>

Figure 10:
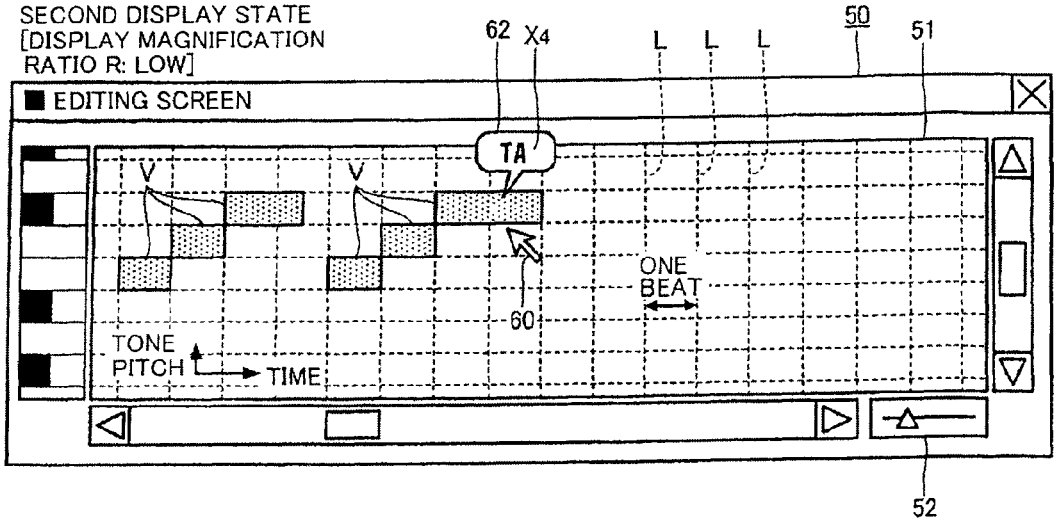
FIG. 10 is a schematic view of the editing screen in the second display state according to a fifth embodiment of the present invention.

FIG. 10 is a schematic view illustrating an editing screen 50 in the second display state according a fifth embodiment. As illustrated in FIG. 10, the display control section 32 displays a pointer (for example, a mouse pointer) 60 operable by a user to designate any position of the display screen on the display device 22. The user can move the pointer 60 to any position by appropriately operating the input device 24.

In the second display state in which the display magnification ratio R is low, the note image V corresponding to each note in a display target portion of a music piece is arranged in the music score display area 51. In the fifth embodiment, the voice code X4 of each note is not displayed, when any note image V is not designated by the pointer 60 in the second display state. That is, when the display magnification ratio R is gradually decreased from the first display state, the voice code X4 of each note is erased at the time point at which the first display state transitions to the second display state.

In the second display state, when a desired note image V in the music score display area 51 is designated by the pointer 60 (for example, the pointer 60 is moved to the vicinity of the desired note image V), the display control section 32 displays the voice code X4 of the note corresponding to the desired note image V on the display device 22. Specifically, as illustrated in FIG. 10, the voice code X4 is arranged in the periphery (the vicinity of the pointer 60) of the desired note image V by a balloon-like image 62. When the designation of the note image V by the pointer 60 is cancelled (for example, the pointer 60 is moved from the note image V to other place), the display (the image 62) of the voice code X4 is cleared. That is, in the fifth embodiment, the voice code X4 of a note designated by the user among the plurality of notes displayed in the music score display area 51 is temporarily displayed in the periphery of the note image V of the note. The display image in the first display state is the same as that of the first embodiment.

In the fifth embodiment, the same advantages as those of the first embodiment can be obtained. In the fifth embodiment, the voice code X4 is not displayed, when the user does not designate any note image V. Therefore, it is possible to obtain the advantage that the music score display area 51 is simplified and the user can easily confirm each note image V (the time series of the notes in the music piece). On the other hand, since the voice code X4 is displayed in the periphery of the note image V in response to the designation by the user, the visibility of the voice code X4 can be sufficiently ensured.

In the above description, the voice code X4 is arranged in the periphery of a single note image V selected by the user. However, the user may arbitrarily select the plurality of note images V. The voice code X4 is displayed for each of the plurality of note images V selected by the user. Further, when a predetermined operation (for example, a pressing operation of a specific operator) is performed on the input device 24, the voice codes X4 of all the designated notes or the voice codes X4 of the some specific notes may be configured to be displayed.

<Sixth Embodiment>

Figure 11:
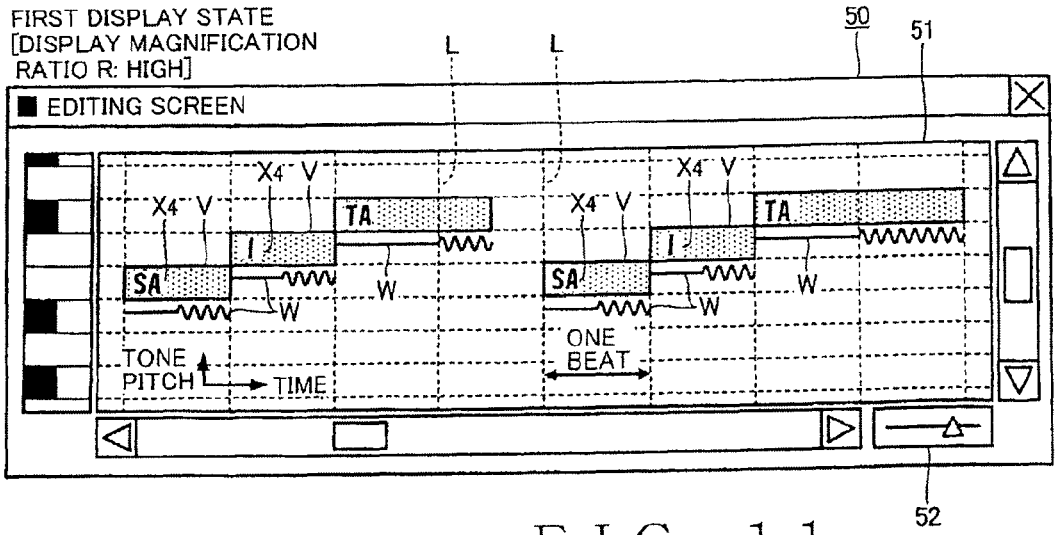
FIG. 11 is a schematic view of the editing screen in the first display state according to a sixth embodiment of the present invention.

FIG. 11 is a schematic view of an editing screen 50 in the first display state according to a sixth embodiment. In the first display state, as illustrated in FIG. 11, the note image V, the voice code X4, and an auxiliary image W are arranged for each note in the music score display area 51. In the first display state, the voice code X4 is arranged inside the note image V, as in the first embodiment.

The auxiliary image W is an image in which adjunctive information indicating the musical feature of each note is schematically shown. For example, the adjunctive information is set in the music data DB. For example, the adjunctive information designates expression parameters such as a volume (velocity) of a note, a vibrato depth or time, an articulation degree such as an opening degree of a mouth in voicing, a fluctuation of a tone pitch (namely pitch bend), presence or absence of portamento, etc. In FIG. 11, the auxiliary image W expressing impartment of the vibrato designated by the adjunctive information is exemplified.

Figure 12:
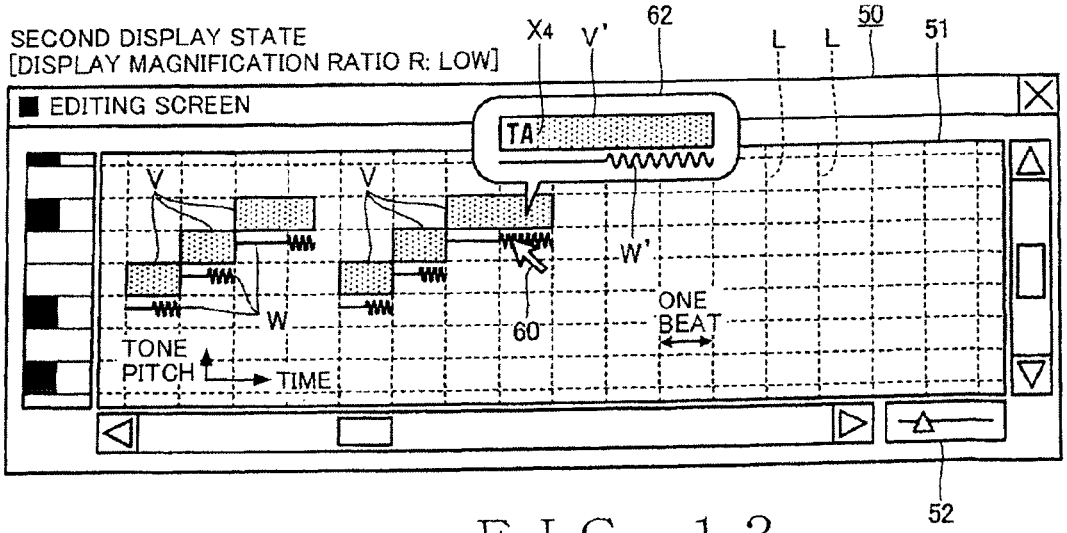
FIG. 12 is a schematic view of the editing screen in the second display state according to the sixth embodiment of the present invention.

FIG. 12 is a schematic view of the editing screen 50 in the second display state according to the sixth embodiment. In the second display state with the lower display magnification ratio R, as illustrated in FIG. 12, the note image V is further reduced in the time axis direction, compared to the first display state, as in the first embodiment, and the auxiliary image W is also reduced in the time axis direction in conjunction with the decrease in the display magnification ratio R. When any note image V is not designated by the pointer 60 in the second display state, the voice code X4 of each note is set so as not to be displayed.

When a desired note image V in the music score display area 51 is designated by user's operation through the pointer 60 in the second display state, as illustrated in FIG. 12, the display control section 32 arranges a note image V, a voice code X4, and an auxiliary image W of the note corresponding to the note image V in the periphery of the note image V designated by the user in the same form (with a similar size) as that of the first display state. Specifically, a balloon-like image 62 is arranged in the periphery of the note image V designated by the user, and the note image V, the voice code X4, the auxiliary image W are arranged inside the image 62 with a size easy for the user to view. Further, the plurality of note images V may be configured to be selected by the user, and the note image V, the voice code X4, and the auxiliary image W of each of the plurality of note images V selected by the user may be displayed in corresponding balloon-like images 62 respectively.

In the sixth embodiment, the same advantages as those of the first embodiment can be obtained. In the sixth embodiment, when one note is designated in the second display state, the auxiliary image W expressing the adjunctive information regarding the note is displayed, together with the voice code X4, in the periphery of the note image V. Therefore, by omitting the display of the voice code X4 of each note in the second display state, it is possible to obtain the advantages that the music score display area 51 is simplified and the user can confirm music information (the voice code X4 and the adjunctive information) of each note in detail. It should be noted that the adjunctive information is the relevant information as well as the voice code X4.

<Seventh Embodiment>

Figure 13:
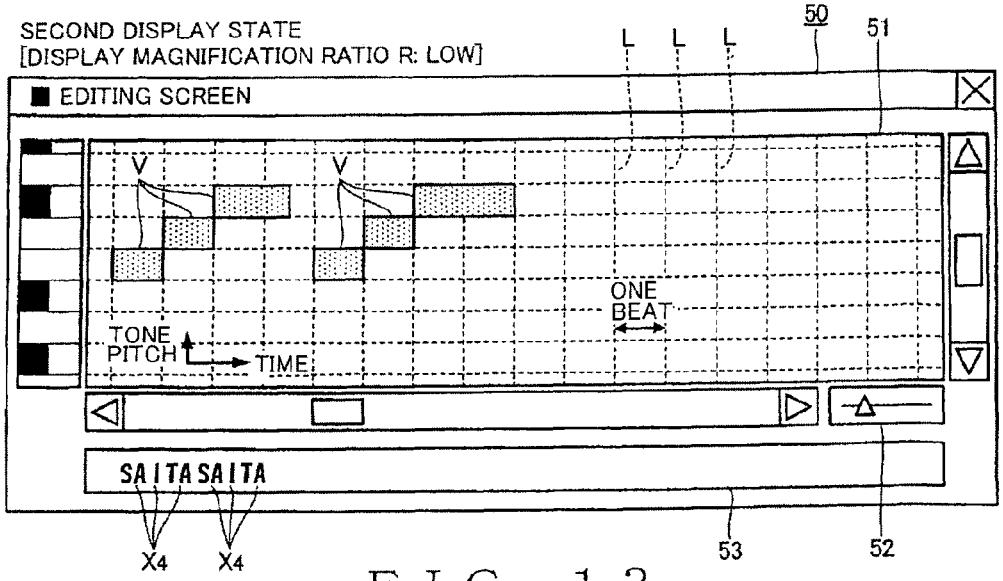
FIG. 13 is a schematic view of the editing screen in the second display state according to a seventh embodiment of the present invention.

FIG. 13 is a schematic view of an editing screen 50 in the second display state according to a seventh embodiment. As illustrated in FIG. 13, the editing screen 50 according to the seventh embodiment includes not only a music score display area 51 in which a note image V of each note is arranged but also an auxiliary area 53. In the second display state with the lower display magnification ratio R, the display control section 32 displays the voice code X4 corresponding to each note in the display target portion in the auxiliary area 53. Specifically, the voice codes X4 are arranged along the time axis at a constant interval in the auxiliary area 53. The voice codes X4 are not displayed in the music score display area 51. Further, in the first display state, the voice code X4 is arranged inside each note image V in the music score display area 51 and the voice code X4 is not displayed in the auxiliary area 53, as in the first embodiment.

In the seventh embodiment, the same advantages as those of the first embodiment can be obtained. In the second display state according to the seventh embodiment, the voice code X4 of each note is arranged in the auxiliary area 53 separate from the music score display area 51. Therefore, it is possible to obtain the advantage that the user can easily view the time series of the voice codes X4, compared to the configuration in which the voice codes X4 are displayed, together with the note images V, in the music score display area 51.

Figure 14:
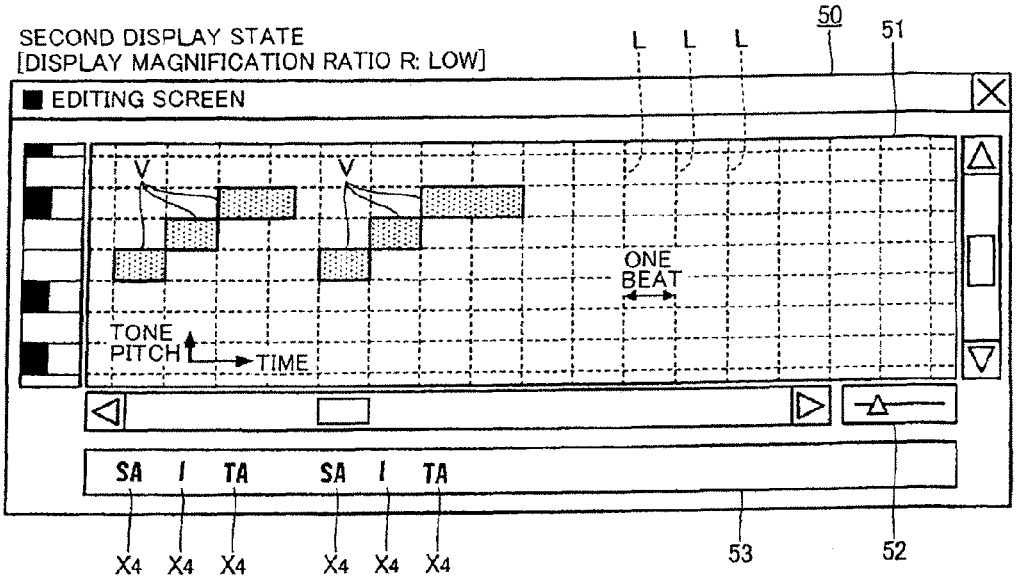
FIG. 14 is a schematic view of the editing screen in the second display state according to a modified example of the seventh embodiment of the present invention.

In the example of FIG. 13, the plurality of voice codes X4 is arranged at the constant interval in the auxiliary area 53. As illustrated in FIG. 14, however, the voice code X4 may be arranged at the position of an end point (that is, the tone generation time point X2 of each note) of each note image V in the time axis direction in the auxiliary area 53. In the configuration of FIG. 14, it is possible to obtain the advantage that the user can easily comprehend the correspondence between each note image V in the music score display area 51 and each voice code X4 in the auxiliary area 53.

As understood from the above description of each embodiment, the display position of the voice code X4 in the second display state is included as the outside of the note image V. That is, the outside of the note image V includes at least the periphery (the inside of the music score display area 51) of the note image V exemplified in the first to sixth embodiments and the inside of the auxiliary area 53 exemplified in the seventh embodiment. On the other hand, the display position of the voice code X4 in the first display state is included as the inside (the inside of the outline of the note image V) of the note image V.

<Eighth Embodiment>

Figure 15:
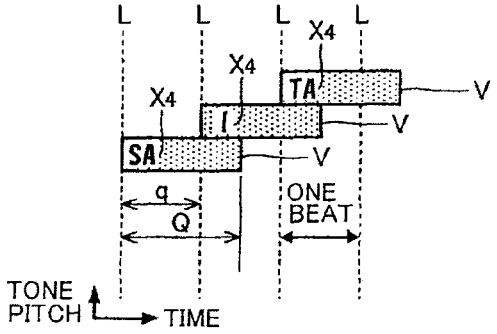
FIG. 15 is a schematic view showing a part of the editing screen in the second display state according to an eighth embodiment of the present invention.

In each embodiment described above, the configuration has been exemplified in which the note image V is reduced in the time axis direction up to the length of the extent that the voice code X4 may not be displayed inside, when the display magnification ratio R is decreased. In an eighth embodiment, as illustrated in FIG. 15, when the display magnification ratio R falls below the threshold value (second display state), the display length of the note image V in the time axis direction is set to a predetermined length (hereinafter, referred to as a "reference length") Q. That is, each note image V is reduced in the time axis direction in conjunction with the decrease in the display magnification ratio R, but is not reduced up to the display length less than the reference length Q. Accordingly, in the second display state in which the display magnification ratio R is less than the threshold value, the display length (reference length Q) of the note image V in the time axis direction is greater than a display length q corresponding to the actual duration length X3 of each note. The reference length Q is set to a length at which the voice code X4 can appropriately be displayed inside the note image V, and the voice code X4 of each note is arranged inside the note image V even in the second display state.

In the eighth embodiment, even when the display magnification ratio R is less than the threshold value, the display length of the note image V in the time axis direction is maintained at the reference length Q and the voice code X4 is arranged inside the note image V. Accordingly, even when the music score display area 51 is reduced and displayed, it is possible to obtain the advantage of ensuring the visibility of the voice code X4.

<Modified Examples>

Each embodiment described above may be modified in various forms. Specific modified examples will be described below. Two or more examples selected arbitrarily from the following examples can be appropriately incorporated.

(1) In each embodiment described above, the music data DB used to synthesize voices has been described, but the music data DB is not limited to the voice synthesizing data For example, the present invention is applicable, even when music data DB expressing a music score of a music piece (for example, a singing music piece) is displayed on the display device 22 (regardless of whether voice synthesis is executed).

(2) In each embodiment described above, lyrics (pronounced characters) have been exemplified as the voice codes X4. For example, phoneme symbols may be configured to be displayed as the voice codes X4 or a combination of pronounced characters and phoneme codes may be configured to be displayed as the voice codes X4. Further, the not-relevant information displayed together with the note image V is not limited to the voice code X4. For example, a code (a character string, a symbol, or an image) expressing a kind of vibrato added to a voice of each note may be displayed inside or outside the note image V instead of the voice code X4 (or together with the voice code X4) of each embodiment described above. For example, when music data DB expressing the music score of an instrumental is displayed on the display device 22, information such as a kind of instrument used to perform each note or the feature of a music tone can be displayed inside or outside the note image V instead of the voice code X4. As understood from the above description, the information displayed inside or outside the note image according to the present invention is included as information (relevant information) associated with each note and the voice code X4 is an example of the relevant information. Further, the relevant information can be also said to be attribute information expressing the attribute of each note. For example, a kind of relevant information (for example, which is displayed among the lyrics, the phoneme codes, the information regarding the vibrato, and the like) to be displayed on the display device 22 may be changed in accordance with a user's operation on the input device 24.

(3) In each embodiment described above, notes of a single performance part of a music piece have been displayed in the music score display area 51. However, the notes of a plurality of performance parts of a music piece may be displayed simultaneously or selectively in the music score display area 51. The note images V may be displayed in different forms (that is, forms in which the note images V of the parts are visually distinguishable in accordance with a difference in hue or gray scale) in each part.

(4) In some embodiments described above, the configuration has been described in which the voice code X4 is not displayed inside the note image V in the second display state. However, the voice code X4 may be displayed both inside and outside of the note image V in the second display state. When the voice code X4 is configured to be displayed both inside and outside the note image V, the display size of the voice code X4 arranged inside the note image V may be decreased in conjunction with the decrease in the display magnification ratio R.

(5) The voice codes X4 (relevant information) displayed in the time series on the display device 22 can be displayed sequentially in a highlighted manner in conjunction with the reproduction progress at the time of synthesizing the voices (at the time of reproducing a music piece). For example, the voice code X4 corresponding to a reproduction position may be configured to be displayed in a different form from the other voice codes X4.

(6) The arrangement positions of the voice codes X4 (relevant information) may be appropriately changed. For example, the voice code X4 may be configured to be arranged at a position (for example, a position over the note image V) designated in advance by a user, or the position of the voice code X4 may be configured to be changed through a user's operation (for example, dragging of a mouse) on the input device 24.

(7) The embodiments described above may be appropriately combined. For example, the auxiliary area 53 of the seventh embodiment in which the voice codes X4 are arranged may be added to the editing screen 50 of the first to sixth embodiments. For example, in the third embodiment in which some of the voice codes X4 are not displayed, the voice code X4 (and the auxiliary information or the like) may be arranged in the periphery of the note image V designated using the pointer 60 by the user, as in the fifth and sixth embodiments.

(8) In each embodiment described above, the voice synthesizing apparatus 100 including the editing processing section 34 and the voice synthesizing section 36 has been exemplified. However, the present invention is also realized in an apparatus (music data display control apparatus) that displays music data DB on the display device 22 or an apparatus (music data editing apparatus) that displays music data DB on the display device 22 and performs editing in response to an instruction from a user. For example, the music data display control apparatus has a configuration in which the editing processing section 34 and the voice synthesizing section 36 are omitted from the voice synthesizing apparatus 100 in FIG. 1. The music data editing apparatus has a configuration in which the voice synthesizing section 36 is omitted from the voice synthesizing apparatus 100. The music data display control apparatus may not include the display device 22 as an essential constituent element and information used for a display instruction and control may be transmitted to the external display device 22.

(9) In each embodiment described above, the configuration has been described in which the storage device 14 storing the voice segments DA and the music data DB is mounted on the voice synthesizing apparatus 100. An external apparatus (for example, a server apparatus) independent from the voice synthesizing apparatus 100 may be configured to store one or both of the voice segments DA and the music data DB. In this case, the voice synthesizing apparatus 100 acquires the voice segments DA and/or the music data DB from the external apparatus (for example, the server apparatus) via, for example, a communication network and performs display of the editing screen 50 or synthesizing voice signals VOUT based on the acquired voice segments DA and/or the acquired music data DB. Accordingly, a constituent element (the storage device 14 described above in each embodiment) that stores the voice segments DA and/or the music data DB is not an essential constituent element of the voice synthesizing apparatus 100.

(10) In each embodiment described above, the voice codes X4 in the Japanese language have been exemplified. However, any language may be used for the voice codes X4. For example, each embodiment described above may be applied likewise, even when the voice codes X4 are displayed in any other language such as English, Spanish, Chinese, or Korean.

This application is based on, and claims priorities to, JP PA No. 2011-242244 filed on 4 Nov. 2011 and, JP PA No. 2012-209486 filed on 24 Sep. 2012. The disclosure of the priority applications, in its entirety, including the drawings, claims, and the specification thereof, are incorporated herein by reference.

What is claimed is:

1. A music data display control apparatus comprising:

a control section adapted to perform display control such that:

a display area, in which a note is displayed on two-axis coordinates configured by a combination of a tone pitch axis and a time axis, is displayed on a display device, a display magnification ratio applied to the display area being variable;

a note image of a given note is displayed in the display area at a position corresponding to a tone pitch and a tone generation time of the given note, a size of the note image being varied in accordance with the display magnification ratio; and relevant information is displayed in association with the note image displayed in the display area, wherein in a first display state in accordance with a first display magnification ratio, the relevant information is positioned inside the note image of the note, and in a second display state in accordance with a second display magnification ratio lower than the first display magnification ratio of the first display state, the relevant information is positioned outside the note image of the note.

2. The music data display control apparatus as claimed in claim 1, wherein in the second display state, the control section performs the display control of the relevant information such that the relevant information is positioned in the periphery of the note image of the note in the display area.

3. The music data display control apparatus as claimed in claim 1, wherein in the second display state, the control section performs the display control such that parts of the relevant information are displayed in line in a time axis direction in the display area.

4. The music data display control apparatus as claimed in claim 1, wherein in the second display state, the control section performs the display control such that a group of a plurality of characters forming the relevant information corresponding to one or more continuous notes is displayed in line in a tone pitch axis direction in the display area.

5. The music data display control apparatus as claimed in claim 1, wherein in the second display state, the control section performs the display control such that when a user designates the note image using a pointer, the relevant information is displayed in association with the note image.

6. The music data display control apparatus as claimed in of claim 1, wherein in the second display state, the control section performs the display control such that the relevant information is displayed in an auxiliary area, other than the display area, set on the display device.

7. A music data display control apparatus comprising:

a control section adapted to perform display control such that:

a display area, in which a note is displayed on two-axis coordinates configured by a combination of a tone pitch axis and a time axis, is displayed on a display device, a display magnification ratio applied to the display area being variable;

a note image of a given note is displayed in the display area to be arranged in correspondence with a tone pitch and a tone generation time of the given note, a size of the note image being varied in accordance with the display magnification ratio; and relevant information is displayed in association with the note image displayed in the display area, wherein in a first display state in accordance with a first display magnification ratio, the relevant information is arranged inside the note image of the note, and in a second display state in accordance with a second display magnification ratio lower than the first display magnification ratio of the first display state, the relevant information is arranged in a manner different from an arrangement in the first display state, wherein in the second display state, the control section performs the display control such that a display length of the note image is maintained at a given reference length and the relevant information is arranged inside the note image along the display length.

8. The music data display control apparatus as claimed in of claim 1, wherein the display magnification ratio is variable in at least one direction of the time axis and the tone pitch axis.

9. A computer-implemented method of controlling display of music data, comprising:

a step of performing display control such that a display area, in which a note is displayed on two-axis coordinates configured by a combination of a tone pitch axis and a time axis, is displayed on a display device, a display magnification ratio applied to the display area being variable;

a step of performing display control such that a note image of a given note is displayed in the display area at a position corresponding to a tone pitch and a tone generation time of the given note, a size of the note image being varied in accordance with the display magnification ratio; and a step of performing display control such that relevant information is displayed in association with the note image displayed in the display area, wherein in a first display state in accordance with a first display magnification ratio, the relevant information is positioned inside the note image of the note, and in a second display state in accordance with a second display magnification ratio lower than the first display magnification ratio of the first display state, the relevant information is positioned outside the note image of the note.

10. A non-transitory computer-readable storage medium containing a group of instructions executable by a computer to perform a method of controlling display of music data, the method comprising:

a step of performing display control such that a display area, in which a note is displayed on two-axis coordinates configured by a combination of a tone pitch axis and a time axis, is displayed on a display device, a display magnification ratio applied to the display area being variable;

a step of performing display control such that a note image of a given note is displayed in the display area at a position corresponding to a tone pitch and a tone generation time of the given note, a size of the note image being varied in accordance with the display magnification ratio; and a step of performing display control such that relevant information is displayed in association with the note image displayed in the display area, wherein in a first display state in accordance with a first display magnification ratio, the relevant information is positioned inside the note image of the note, and in a second display state in accordance with a second display magnification ratio lower than the first display magnification ratio of the first display state, the relevant information is positioned outside the note image of the note.

11. The music data display control apparatus as claimed in claim 1, wherein said control section is further adapted to:

determine whether the display magnification ratio is greater than a predetermined threshold value or not; and control the display style of the relevant information in such a manner that the relevant information is displayed in the first display state when the display magnification ratio is greater than the predetermined threshold value, and that the relevant information is displayed in the second display state when the display magnification ratio is equal to or less than the predetermined threshold value.

12. The music data display control apparatus as claimed in claim 7, wherein said control section is further adapted to:

determine whether the display magnification ratio is greater than a predetermined threshold value or not; and control the display style of the relevant information in such a manner that the relevant information is displayed in the first display state when the display magnification ratio is greater than the predetermined threshold value, and that the relevant information is displayed in the second display state when the display magnification ratio is equal to or less than the predetermined threshold value.

13. The music data display control apparatus as claimed in claim 7, wherein the display length of the note image maintained at the given reference length in the second display state is a length in a time axis direction in the display area.

14. A computer-implemented method of controlling display of music data, comprising:

a step of performing display control such that a display area, in which a note is displayed on two-axis coordinates configured by a combination of a tone pitch axis and a time axis, is displayed on a display device, a display magnification ratio applied to the display area being variable;

a step of performing display control such that a note image of a given note is displayed in the display area to be arranged in correspondence with a tone pitch and a tone generation time of the given note, a size of the note image being varied in accordance with the display magnification ratio; and a step of performing display control such that relevant information is displayed in association with the note image displayed in the display area, wherein in a first display state in accordance with a first display magnification ratio, the relevant information is arranged inside the note image of the note, and in a second display state in accordance with a second display magnification ratio lower than the first display magnification ratio of the first display state, the relevant information is arranged in a manner different from an arrangement in the first display state, wherein in the second display state, the control section performs the display control such that a display length of the note image is maintained at a given reference length and the relevant information is arranged inside the note image along the display length.

15. The method as claimed in claim 14, wherein said a step of performing display control includes the steps of:

determining whether the display magnification ratio is greater than a predetermined threshold value or not; and controlling the display style of the relevant information in such a manner that the relevant information is displayed in the first display state when the display magnification ratio is greater than the predetermined threshold value, and that the relevant information is displayed in the second display state when the display magnification ratio is equal to or less than the predetermined threshold value.

16. The method as claimed in claim 14, wherein the display length of the note image maintained at the given reference length in the second display state is a length in a time axis direction in the display area.

17. A non-transitory computer-readable storage medium containing a group of instructions executable by a computer to perform a method of controlling display of music data, the method comprising:

a step of performing display control such that a display area, in which a note is displayed on two-axis coordinates configured by a combination of a tone pitch axis and a time axis, is displayed on a display device, a display magnification ratio applied to the display area being variable;

a step of performing display control such that a note image of a given note is displayed in the display area to be arranged in correspondence with a tone pitch and a tone generation time of the given note, a size of the note image being varied in accordance with the display magnification ratio; and a step of performing display control such that relevant information is displayed in association with the note image displayed in the display area, wherein in a first display state in accordance with a first display magnification ratio, the relevant information is arranged inside the note image of the note, and in a second display state in accordance with a second display magnification ratio lower than the first display magnification ratio of the first display state, the relevant information is arranged in a manner different from an arrangement in the first display state, wherein in the second display state, the control section performs the display control such that a display length of the note image is maintained at a given reference length and the relevant information is arranged inside the note image along the display length.

18. The non-transitory computer-readable storage medium as claimed in claim 17, wherein said a step of performing display control includes the steps of:

determining whether the display magnification ratio is greater than a predetermined threshold value or not; and controlling the display style of the relevant information in such a manner that the relevant information is displayed in the first display state when the display magnification ratio is greater than the predetermined threshold value, and that the relevant information is displayed in the second display state when the display magnification ratio is equal to or less than the predetermined threshold value.

19. The non-transitory computer-readable storage medium as claimed in claim 17, wherein the display length of the note image maintained at the given reference length in the second display state is a length in a time axis direction in the display area.

* * * * *